US007398800B2

(12) United States Patent
Kusakari et al.

(10) Patent No.: US 7,398,800 B2
(45) Date of Patent: Jul. 15, 2008

(54) REINFORCING BAR BINDING MACHINE

(75) Inventors: Ichiro Kusakari, Tokyo (JP); Takahiro Nagaoka, Tokyo (JP); Osamu Itagaki, Tokyo (JP); Atsushi Matsuoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/795,136

(22) PCT Filed: Dec. 27, 2005

(86) PCT No.: PCT/JP2005/024229

§ 371 (c)(1),
(2), (4) Date: Jul. 12, 2007

(87) PCT Pub. No.: WO2006/075538

PCT Pub. Date: Jul. 20, 2006

(65) Prior Publication Data

US 2008/0006341 A1 Jan. 10, 2008

(30) Foreign Application Priority Data

Jan. 13, 2005 (JP) ..... 2005-006818

(51) Int. Cl.
*B65B 13/28* (2006.01)

(52) U.S. Cl. ..... 140/118; 140/93.6; 140/57; 100/29; 100/31

(58) Field of Classification Search ..... 140/118, 140/119, 57, 93.6; 100/29, 30, 31
See application file for complete search history.

(56) References Cited

U.S. PATENT DOCUMENTS

| | | | | |
|---|---|---|---|---|
| 5,279,336 | A * | 1/1994 | Kusakari et al. | 140/57 |
| 2005/0005991 | A1 * | 1/2005 | Ishikawa et al. | 140/119 |
| 2006/0254666 | A1 * | 11/2006 | Kusakari et al. | 140/57 |

FOREIGN PATENT DOCUMENTS

| | | |
|---|---|---|
| JP | 10-46821 | 2/1998 |
| JP | 2001-62744 | 3/2001 |
| JP | 2003-136435 | 5/2003 |
| WO | 03/010048 | 2/2003 |

* cited by examiner

*Primary Examiner*—Dmitry Suhol
(74) *Attorney, Agent, or Firm*—Drinker Biddle & Reath LLP

(57) ABSTRACT

A reinforcing bar binding machine is provided with a control unit operated in such a manner that at the time of turning on an electric power source switch, a setting position of a motor drive adjustment dial and a state of a trigger lever are read, and when the motor drive adjustment dial is at a specific setting position and when the trigger lever is turned on, a binding wire cutting mechanism is driven by a predetermined number of times for warming up the binding wire cutting mechanism. When the warming-up operation is carried out in a cold environment, it is possible to reduce the viscosity of grease coated on a mechanism portion. Therefore, it is possible to lower a viscosity of grease applied on a mechanical portion and conduct a reinforcing bar binding work without wasting a binding wire in the same manner as that in a warm environment.

3 Claims, 5 Drawing Sheets

W
21a
19
20
21
22
PULL
15
3
16
13
14
3
15
16
17
18

REINFORCING BAR BINDING MACHINE

TECHNICAL FIELD

The present invention is related to a reinforcing bar binding machine. More particularly, the present invention is related to a reinforcing bar binding machine having a warming-up function so as to prevent the occurrence of failure in operation in a low temperature environment.

BACKGROUND ART

It is a matter of general knowledge to appropriately use lubricant for a rotary shaft, a sliding face of a piston and a frictional face of a gear or a cam in a power tool such as an electric tool or a pneumatic tool. Concerning this matter, for example, refer to JP-A-2003-136435. In the case of lubrication of a rotary shaft or a sliding member, the sliding speed of which is relatively low, to which a heavy load is given, provided in a binding wire twisting mechanism of a reinforcing bar binding machine, grease of higher viscosity is used.

In the case where the reinforcing bar binding machine is used outside where a temperature is very low, the viscosity of grease is increased and a sliding resistance of a rotary shaft or a sliding member is raised. Accordingly, it becomes impossible to exhibit the original performance of the binding machine. In the environment of low temperature, a battery voltage is reduced and an output of a motor is lowered. Accordingly, in addition to the increase in the viscosity of grease, due to the reduction in the battery voltage, an operation speed of a mechanism portion is decreased and further an operating force of the mechanism portion becomes weak. Consequently, there is a possibility that failure in operation is caused and further it becomes impossible to start the binding machine.

DISCLOSURE OF THE INVENTION

Therefore, one or more embodiments of the present invention provide a reinforcing bar binding machine in which no failure in operation is caused even when the reinforcing bar binding machine is used in a cold environment.

According to one or more embodiments of the present invention, a reinforcing bar binding machine is provided with: a binding wire feed mechanism for forming a binding wire loop round reinforcing bars when a binding wire wound round a reel is sent to a binding wire guide nose; and a binding wire twist mechanism for twisting the binding wire loop so as to bind the reinforcing bars. The reinforcing bar binding machine also includes: a usual reinforcing bar binding mode; and a warming-up mode in which the binding wire twist mechanism is driven by a predetermined times, wherein it is possible to select between the reinforcing bar binding mode and the warming-up mode.

According to one or more embodiments of the present invention, a reinforcing bar binding machine is further provided with a control unit which reads in a setting position of a motor driving adjustment dial and also reads in a state of a trigger lever at the time of turning on a power source switch and which starts a warming-up action in the case where the motor driving adjustment dial is set at a specific setting position and the trigger lever is turned on.

According to one or more embodiments of the present invention, a method of warming up a reinforcing bar binding machine is provided a step of reciprocating the binding wire twist mechanism by a predetermined times while the binding wire feed mechanism is being maintained in a non-operation state.

According to one or more embodiments of the present invention, when a warming-up mode is selected in a reinforcing bar binding machine, a warming-up operation, in which a binding wire cutting mechanism is driven by a predetermined times, is carried out. Therefore, even in an environment of low temperature, it is possible to evade the occurrence of a case in which it is difficult to start a reinforcing bar binding machine due to an increase in the viscosity of lubricant. Accordingly, it is possible to solve a problem in which the performance of the reinforcing bar binding machine is deteriorated when it is used in a cold environment. When not a usual operation cycle of the reinforcing bar binding machine but only a binding wire cutting operation is carried out, the binding wire is not wasted.

When it is composed in such a manner that a warming-up operation is started by a combination of a setting position of the motor drive adjustment dial and a state of the trigger lever, it becomes unnecessary to provide a specific operation mode selecting switch. Therefore, the number of parts is not increased.

Other aspects and advantages of the invention will be apparent from the following description and the appended claims.

BRIEF DESCRIPTION OF THE DRAWINGS

FIG. 3(*b*) is a side view showing the binding wire feed mechanism.

Figure 1:
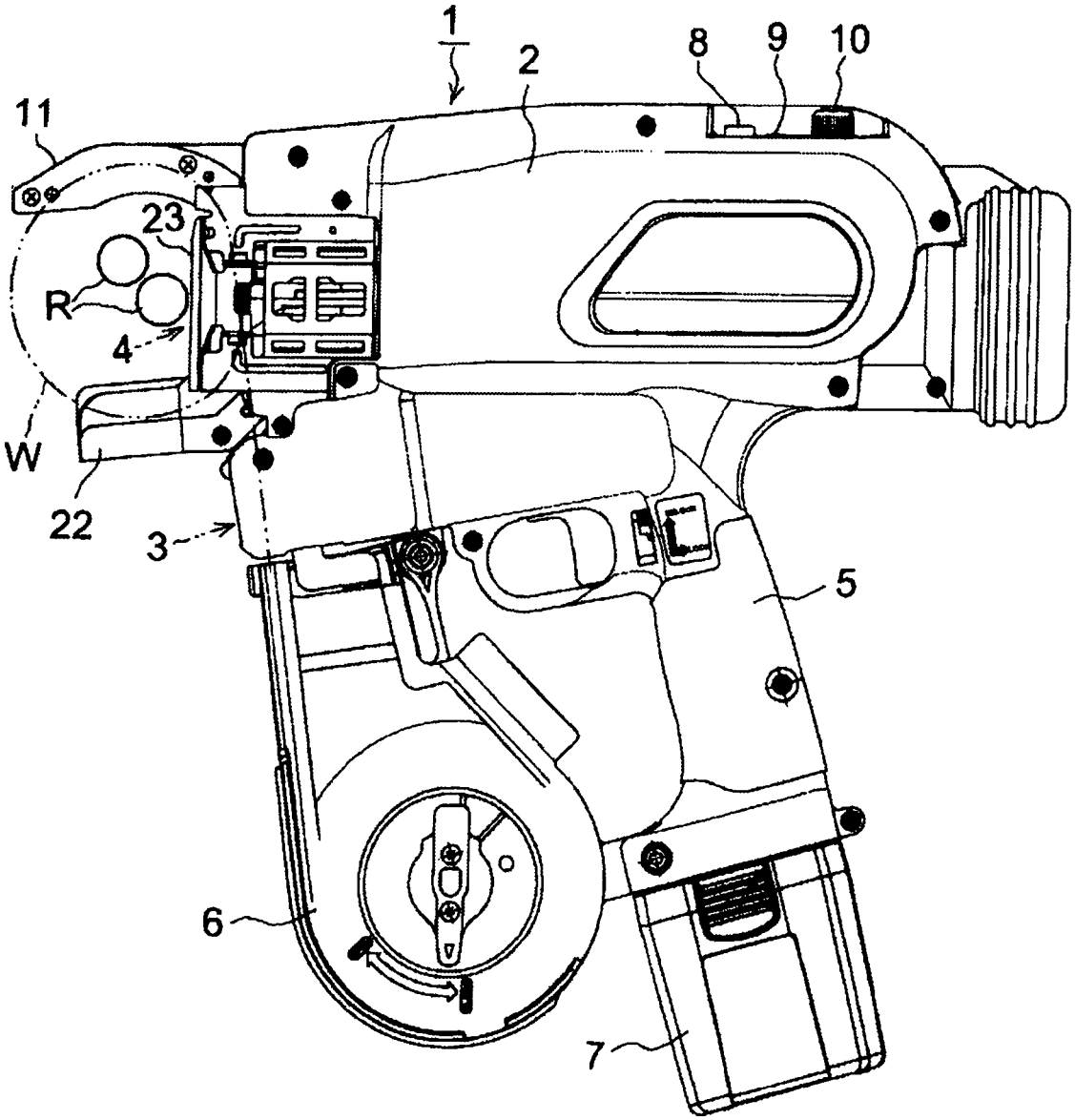
FIG. 1 is a side view showing a reinforcing bar binding machine.

In this connection, each reference numeral in the drawing shows each component as follows. Reference numeral 1 is a reinforcing bar binding machine, reference numeral 2 is a housing, reference numeral 3 is a binding wire feed mechanism, reference numeral 4 is a binding wire twist mechanism, reference numeral 5 is a grip portion, reference numeral 6 is a magazine, reference numeral 7 is a battery pack, reference numeral 8 is an electric power switch, reference numeral 9 is a voltage warning LED, reference numeral 10 is a twist torque setting dial, reference numeral 11 is a binding wire guide nose, reference numeral 12 is a trigger lever, reference numeral 19 is a rotary cutter, reference numeral 20 is a pin, reference numeral 21 is a cutter lever, reference mark R is a reinforcing bar and reference mark W is a binding wire.

BEST MODE FOR CARRYING OUT THE INVENTION

Referring to the drawings, an embodiment of the present invention will be explained below.

FIG. 1 is a view showing an electric type reinforcing bar binding machine 1. A binding wire feed mechanism 3 and a binding wire twist mechanism 4 are incorporated into a housing 2. In a magazine 6 arranged in the front of a grip portion 5 of the housing 2, a binding wire reel (not shown) is charged. To an end portion of the grip portion 5, a battery pack 7, into which NiMH battery is incorporated, is attached. Through an electric power circuit board (not shown), the battery pack 7 supplies electric power to a feed motor of the binding wire feed mechanism 3 and a feed motor of the binding wire twist mechanism 4.

Figure 2:
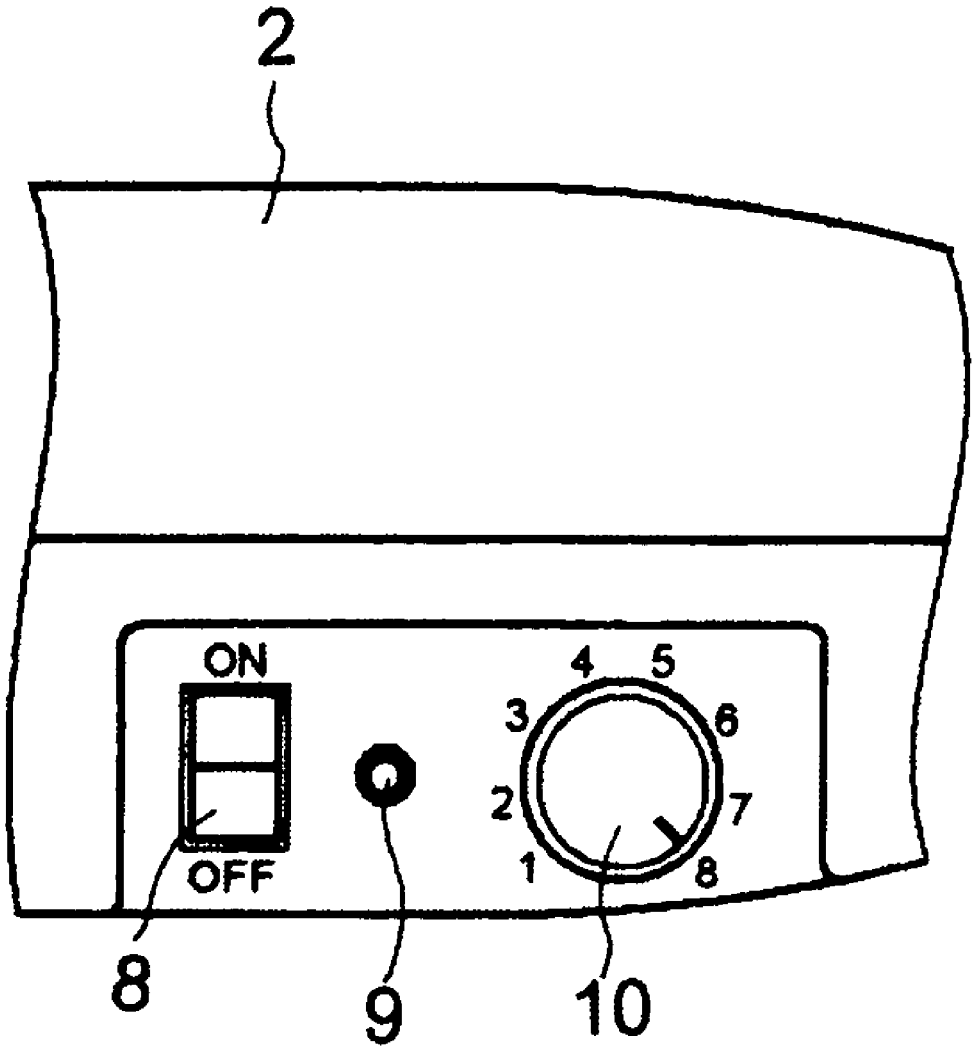
FIG. 2 is a plan view showing a power switch portion of the reinforcing bar binding machine.

As shown in FIGS. 1 and 2, there are provided an electric power source switch 8, a warning detection LED 9 and a twist torque adjustment dial 10 on an upper face at the rear of the reinforcing bar binding machine 1. In the housing 2, a buzzer (not shown) for warning related to voltage is provided. In the periphery of the twist torque adjustment dial 10, graduations from 1 to 8 are indicated. When an indicator of the twist torque adjustment dial 10 is adjusted at the graduation of 8, the twist torque can be set at the maximum value.

When the battery pack 7 is attached to the reinforcing bar binding machine 1 and then the electric power switch 10 is turned on, an initializing action of the reinforcing bar binding machine 1 is carried out. In the initializing action, the binding wire feed mechanism 3 feeds a predetermined length of the binding wire toward the binding wire guide nose 11 arranged on the upside. Then, a forward end portion of the binding wire is cut off with a rotary cutter of a binding wire cutting mechanism described later, so that the forward end portion of the binding wire can be positioned. The binding wire twist mechanism 4 conducts a series of actions including a clamping action and a twisting action under the condition that the binding wire twist mechanism 4 does not hold the binding wire. After that, the binding wire twist mechanism 4 is stopped at an initial position and put into a standby state. After the binding wire twist mechanism 4 has been put into the standby state, when the trigger lever 12 is pulled, one cycle of the reinforcing bar binding action, which includes a feeding action of the binding wire, a clamping action, a drawing action, a cutting action and a twisting action, is continuously carried out.

A control portion watches voltage of the battery pack 7 through a voltage detection circuit during a binding action. When voltage of the battery pack 7 drops to a predetermined voltage at which it is recommended to charge the battery pack 7, the buzzer is made to ring and warning detection LED 9 is turned on so that a reduction of voltage is informed. When an indicator of the twist torque adjustment dial 10 is adjusted at the graduation 8 and the electric power source switch is turned on under the condition that the trigger lever is pulled, the control portion is put into the warming-up mode described later and a binding wire cutting action is repeatedly carried out by a predetermined times.

Figures 3A, 3B:
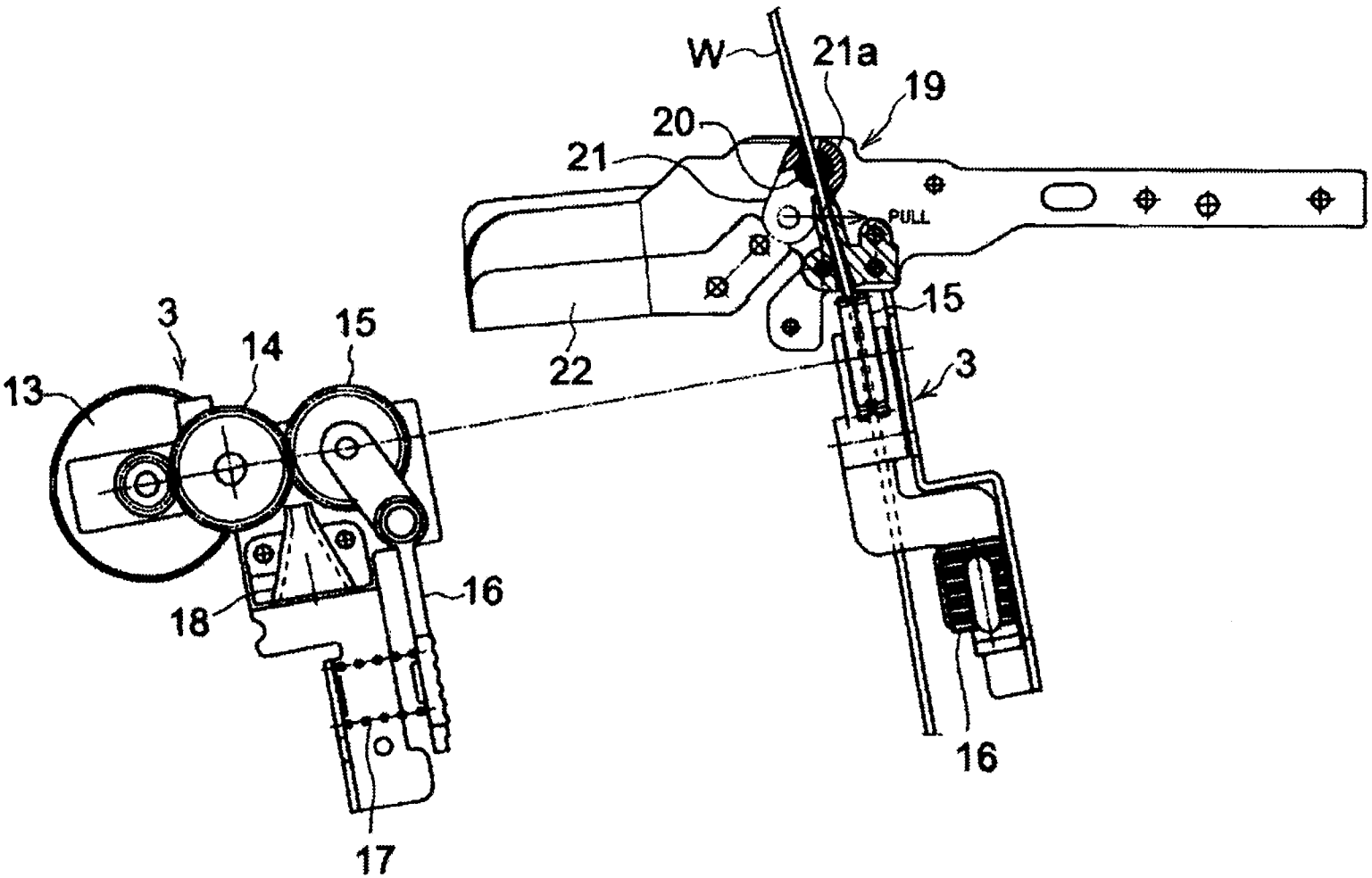
FIG. 3(*a*) is a front view showing a binding wire feed mechanism.

As shown in FIG. 3(*a*), the binding wire feed mechanism 3 includes: a driving gear 14 having a V-groove that is driven by a feed motor 13; and a driven gear 15 having a V-groove which is meshed with the driving gear 14 having the V-groove. A binding wire is sent out being interposed between the driving gear 14 having the V-groove and the driven gear 15 having the V-groove. Binding wire W is sent upward from a binding wire reel arranged in the magazine. Binding wire W, which has been sent out from the binding wire reel, is formed into an arcuate shape along a guide groove on an inner circumference of the binding wire guide nose 11 shown in FIG. 1 and goes round reinforcing bars R, and a tip portion of binding wire W threads between the clamps of the binding wire twist mechanism 4.

The driven gear 15 having the V-groove is attached to a lever 16 and elastically contacted with the driving gear 14 having the V-groove by a spring force generated by a compressive coil spring 17 attached to the lever 16. When a lower end portion of the lever 16 is pushed to the central side, that is, to the left in FIG. 3(*a*), the driven gear 15 having the V-groove, which is attached to an upper portion of the lever 16, is separated from the driving gear 14 having the V-groove arranged on the motor 13 side. Therefore, binding wire W can be threaded between the driving gear 14 having the V-groove and the driven gear 15 having the V-groove. In a lower portion between the two gears 14 and 15, a funnel-shaped binding wire guide 18 is provided. Binding wire W is threaded into the binding wire guide 18 from below and set between the driving gear 14 having the V-shaped groove and the driven gear 15 having the V-groove.

In an upper portion of the binding wire feed mechanism 3, a rotary cutter 19 for cutting the binding wire is arranged. The rotary cutter 19 includes: a columnar pin 20 in which a groove is formed in the radial direction; and a cutter lever 21 engaged with the pin 20. In a pin engaging portion of the cutter lever 21, a cutter portion 21*a* corresponding to the groove of the pin 20 is formed. When the binding wire is threaded into the groove of the pin 20 and then the cutter lever 21 is rotated, a cutter portion 21*a* of the cutter lever 21 shears binding wire W at a position on the outer circumference of the pin 20.

Figure 4:
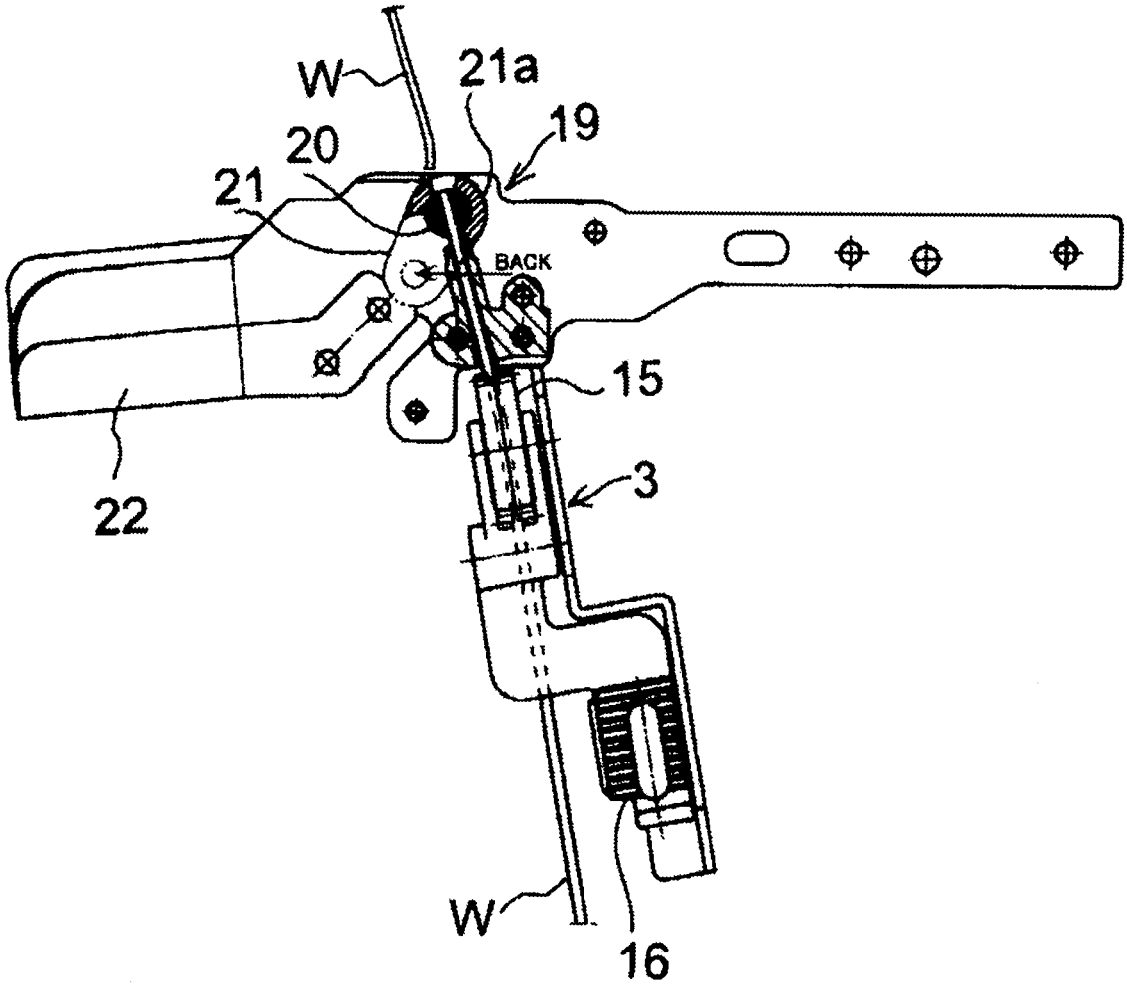
FIG. 4 is a side view showing the binding wire feed mechanism in a state in which a binding wire is cut off.

Although not shown in the drawing, an end portion of the cutter lever 21 is connected to a slider of the binding wire twist mechanism 4 through a link and moved being linked with the binding wire twist mechanism 4. Therefore, the end portion of the cutter lever 21 rotates in the arrowed direction from the initial position shown in FIG. 3(*b*) so that the binding wire can be cut. As shown in FIG. 4, after the end portion of the cutter lever 21 has cut off the binding wire, it is returned to the initial position being linked with the binding wire twist mechanism.

The binding wire twist mechanism 4 includes: a twist shaft not shown in FIG. 1; and three clamping plates attached to a forward end portion of the twist shaft. The three clamping plates are arranged inside the side cover 23 which is located between the binding wire guide nose 11 and the lower side guard 22. Two clamping plates, which are arranged on both sides of the fixed central clamping plate, are opened and closed by a cam mechanism.

The binding wire is sent out from between the central clamping plate and one of the outside clamping plates. The control unit (not shown) stops feeding the binding wire after the binding wire corresponding to the predetermined number of turns has been sent out. At this time, a tip portion of the binding wire reaches a predetermined position in the binding wire guide nose 11. The clamping plate of the binding wire twist mechanism 4 clamps a binding wire loop and pulls back the binding wire. At the same time, the binding wire twist mechanism 4 slides and cuts off a rear end of the binding wire loop. Therefore, the binding wire loop is cut away from the successive binding wire. Next, when the twist shaft of the binding wire twist mechanism 4 and the clamping plate are driven being rotated and a clamp portion of the binding wire loop is twisted, the reinforcing bars are bound. When an intensity of twist torque of the twist motor is raised to a predetermined setting value, twisting operation is stopped. After that, the twist motor is reversed and the clamping plate is opened and the twist shaft is returned to the initial position. In this way, one cycle of the binding step is completed.

Next, a warming-up function will be explained below. In the case where the outside air temperature is low, the viscosity of grease coated on the binding wire twist mechanism 4 is raised, which causes problems in the operation of the binding wire twist mechanism 4. In order to solve the above problems caused in the environment of low temperature, the reinforcing bar binding machine 1 includes a warming-up function. In this case, the control system is composed as follows. When the electric power source is turned on while the twist torque adjustment dial 10 and the trigger lever 12 (the trigger switch) are being respectively maintained in a specific state, the warming-up mode is attained.

Figure 5:
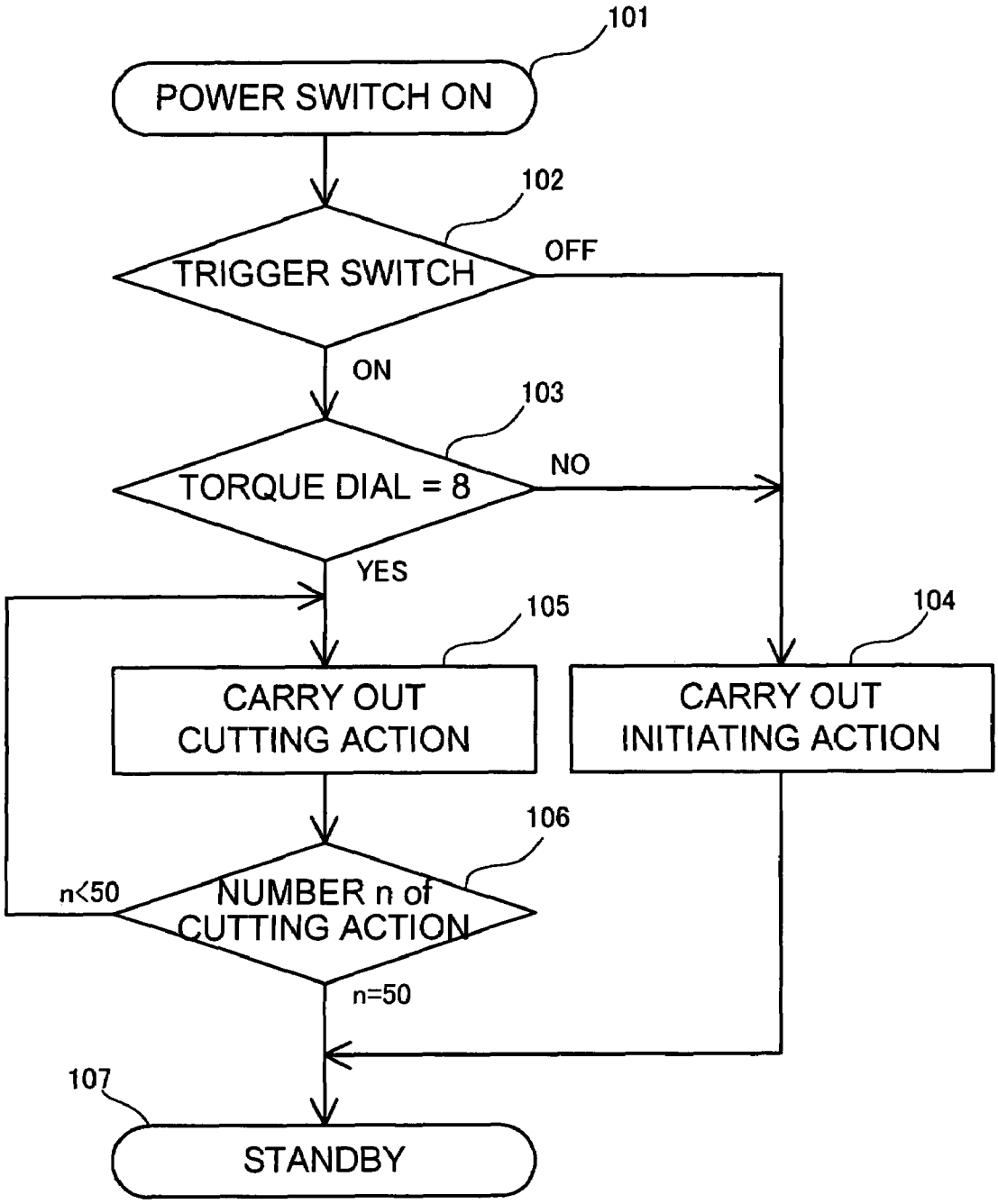
FIG. 5 is a flow chart at the time of turning on an electric power source of the reinforcing bar binding machine.

FIG. 5 is a flow chart showing operation at the time of starting. When the electric power source switch 8 is turned on (step 101), the control unit reads in states of the trigger lever 12 and the twist torque dial 10 (steps 102 and 103). In the case where the trigger lever 12 is turned off or the twist torque adjustment dial 10 is set at a graduation except for the graduation 8, a usual initialization action is carried out which includes a binding wire feed action, a binding wire twist mechanism drive action, a binding wire cutting action and an initialization position returning action (step 104). After the above actions have been carried out, the binding machine is put into a state of standby (step 107).

On the other hand, in the case where the electric power source switch is turned on while the twist torque adjustment dial 10 is being set at the graduation 8 and the trigger lever 12 is being pulled, the binding machine is put into the warming-up mode. Therefore, a reciprocating action of the binding wire twist mechanism 4 is carried out, that is, a binding wire cutting action is carried out (step 105). This action is repeated until the number of the cutting actions reaches 50 times (step 106). After the binding wire cutting action has been carried out by 50 times, the binding machine is put into the state of standby (step 107). Due to the above operation, a temperature of grease is raised and viscosity is lowered. Further, a temperature of NiMH battery is also raised and NiMH battery is activated. Therefore, even when the outside temperature is low, it is possible to conduct a normal binding action.

In this warming-up mode, the binding wire is not fed but the binding wire is only cut off. Therefore, the cutting wire is not wasted. In the case where the warming-up operation is stopped for some reasons, only when the electric power source switch 8 is turned off, the electric power source can be shut off and all actions of the binding machine are stopped. In the above embodiment, the motor drive adjustment dial is used as a torque adjustment dial. However, the torque adjustment dial is not limited to the motor drive adjustment dial. An adjustment dial for adjusting a motor rotation or motor speed may be used as the torque adjustment dial.

In this connection, it should be noted that variations may be made within a scope of the present invention. It is apparent that the present invention can be applied to a power tool except for the reinforcing bar binding machine. In addition, it is apparent that these variations or changes can also be included in the scope of the invention.

The present application is based on Japanese Patent Application No. 2005-006818 filed on Jan. 13, 2005, the contents of which are hereby incorporated by reference.

INDUSTRIAL APPLICABILITY

According to one or more embodiments of the present invention, it is possible to prevent the occurrence of failure in operation when a reinforcing bar binding machine is used in an environment of low temperature.

The invention claimed is:

1. A reinforcing bar binding machine comprising:

a binding wire feed mechanism that feeds a binding wire to a binding wire guide nose and forms a binding wire loop around reinforcing bars;

a binding wire twist mechanism that twists the binding wire loop and binds the reinforcing bars;

a usual reinforcing bar binding mode;

a warming-up mode in which the binding wire twist mechanism is driven by a predetermined times, wherein it is possible to select between the reinforcing bar binding mode and the warming-up mode; and a control unit that reads a setting position of a motor driving adjustment dial and a state of a trigger lever at the time of turning on a power source switch, and starts a warming-up action in the case where the motor driving adjustment dial is set at a specific setting position and the trigger lever is turned on.

2. A method of warming up a reinforcing bar binding machine including a binding wire feed mechanism and a binding wire twist mechanism, the method comprising:

reading a setting position of a motor driving adjustment dial and a state of a trigger lever at the time of turning on a power source switch;

starting a warming-up action in the case where the motor driving adjustment dial is set at a specific setting position and the trigger lever is turned on; and reciprocating the binding wire twist mechanism by a predetermined times while the binding wire feed mechanism is being maintained in a non-operation state, in the warming up action.

3. A reinforcing bar binding machine comprising:

a binding wire feed mechanism that feeds a binding wire to a binding wire guide nose and forms a binding wire loop around reinforcing bars;

a binding wire twist mechanism that twists the binding wire loop and binds the reinforcing bars;

a usual reinforcing bar binding mode;

a warming-up mode in which the binding wire twist mechanism is driven by a predetermined times, wherein it is possible to select between the reinforcing bar binding mode and the warming-up mode; and a control unit that starts a warming-up action by a specific operation of a motor adjustment dial, a trigger lever and a power source switch.

* * * * *